US006415806B1

(12) United States Patent
Gillis

(10) Patent No.: US 6,415,806 B1
(45) Date of Patent: Jul. 9, 2002

(54) FLEXIBLE STRUCTURE AND METHOD

(76) Inventor: Robert E. Gillis, 224 W. O'Connor, Menlo Park, CA (US) 94025

( * ) Notice: Subject to any disclaimer, the term of this patent is extended or adjusted under 35 U.S.C. 154(b) by 0 days.

(21) Appl. No.: 09/680,232

(22) Filed: Oct. 6, 2000

Related U.S. Application Data

(63) Continuation-in-part of application No. 09/079,246, filed on May 14, 1998, now Pat. No. 6,145,527.

(51) Int. Cl.[7] ..... E04H 15/36
(52) U.S. Cl. ..... 135/124; 135/127
(58) Field of Search ..... 135/124, 127, 135/87, 121, 156, 137

(56) References Cited

U.S. PATENT DOCUMENTS

| | | | | |
|---|---|---|---|---|
| 3,314,630 | A | | 4/1967 | Lewis, Sr. |
| 3,749,107 | A | | 7/1973 | Laberge |
| 3,843,410 | A | | 10/1974 | Gillis |
| 3,863,659 | A | | 2/1975 | Gillis |
| 3,986,519 | A | | 10/1976 | Gillis |
| 4,099,533 | A | | 7/1978 | Gillis |
| 4,175,305 | A | | 11/1979 | Gillis |
| 4,265,259 | A | | 5/1981 | Gillis |
| 4,265,260 | A | | 5/1981 | Gillis |
| 4,308,647 | A | | 1/1982 | Gillis |
| 4,414,993 | A | | 11/1983 | Gillis |
| 4,706,696 | A | | 11/1987 | Gillis |
| 4,809,726 | A | | 3/1989 | Gillis |
| 4,944,322 | A | | 7/1990 | Gillis |
| 5,388,311 | A | | 2/1995 | Solbeck |
| 5,477,876 | A | | 12/1995 | Moss |
| 5,642,750 | A | | 7/1997 | Brown |
| 6,145,527 | A | * | 11/2000 | Gliils ..... 135/124 |

FOREIGN PATENT DOCUMENTS

| | | |
|---|---|---|
| DE | 2521913 | 11/1976 |
| GB | 1103575 | 5/1965 |

OTHER PUBLICATIONS (5) Sierra Designs Catalogs depicting tents and connectors, Sierra Designs, 1255 Powell Street, Emeryville, California 94608.

(1) Recreational Equipment Inc. Catalog depicting tents and connectors, 1700 45th Street East, Sumner, Washington 98390.

Mountain Hard Wear Catalog, pp. 6–15 depicting tents and connectors, 950 Gilman Street, Berkeley, California 94710.

* cited by examiner

*Primary Examiner*—Beth A. Stephan
(74) *Attorney, Agent, or Firm*—Townsend and Townsend and Crew LLP

(57) ABSTRACT

A flexible structure is described having one or more deformable, resilient poles and one or more tension webs associated therewith, having strut members, and being coupled to the poles to maintain the pole(s) in a selected shape under tension and to impart strength and rigidity to the structure. A flexible membrane may also be provided to define a sheltered space.

20 Claims, 16 Drawing Sheets

FLEXIBLE STRUCTURE AND METHOD

RELATED APPLICATION(S)

This is a continuation-in-part of application Ser. No. 09/079,246 filed May 14, 1998 now U.S. Pat. No. 6,145,527.

BACKGROUND OF THE INVENTION

1. Field of the Invention

This invention relates to flexible structures having a broad range of utility. More specifically, the present invention relates to a flexible structure, which may find application as a tent or shelter, among other things, being of a type having at least one pole or rod maintained under tension in a selected shape, and a flexible member associated therewith, the structure exhibiting improved strength and rigidity in response to external loading forces, such as wind, rain, etc.

2. Description of the Prior Art

Convex multi-poled tent structures are described in U.S. Pat. Nos. 3,986,519, 4,099,533, 4,265,260, and 4,414,993, all of which are commonly assigned to the assignee of the present invention, and all of which are incorporated herein by reference as if repeated verbatim. U.S. Pat. Nos. 3,986,519 and 4,099,533 both disclose dome-like structures composed of a plurality of pole or rod elements maintained under tension in a generally arcuate shape, and an underlying membrane. Each structure includes at least two intersecting sets of such pole or rod elements. The rod or pole elements are held in fixed relationship at intersections by fittings secured to the underlying flexible membrane or sheath. The underlying membrane or sheath acts as a tension member to maintain the poles under tension. This structure, which employs the underlying membrane to tension the poles, lacks the added rigidity and strength of the structure of the present invention, which employs tension elements.

U.S. Pat. Nos. 4,265,260 and 4,414,993 disclose a flexible vault structure which similarly includes a plurality of deformable resilient poles that are held under tension in generally arcuate shape by an underlying fabric member. U.S. Pat. No. 4,265,260 discloses the use of fabric sleeves in addition to fittings for coupling the poles to the underlying fabric member. This structure similarly lacks the added rigidity and strength of the structure of the present invention, which includes additional tension elements.

Some multi-poled tent structures in the past have used internal guylines or similar structures located inside the enclosed space defined by the membrane in an effort to impart additional rigidity and strength to the structure. The guylines have generally extended between poles that define the structure and have consisted at most of two intersecting lines. Thus not only have the guylines failed to impart additional strength and rigidity to each pole, they have also interfered with the use of the enclosed space.

What is needed therefor and what has been invented is a flexible structure that exhibits improved rigidity and strength over prior art structures, and that overcomes the foregoing deficiencies associated with the prior art. More particularly, what is needed and what has been invented is a flexible structure comprising at least one deformable resilient pole with a tension web assembly coupled thereto in order to maintain the pole in a selected, e.g., a generally arcuate, shape under tension. The tension web assembly maintains the pole in its desired shape under tension and provides improved rigidity and strength when the structure is subjected to external load forces such as snow, wind, rain, etc. An underlying membrane may be coupled to the tension web assembly to provide a highly stable, rigid, and strong shelter structure, for example a tent.

Also provided is a method for making such a structure, including a method for maintaining one or more of a plurality of deformable resilient poles in a selected, e.g. generally arcuate, shape under tension such that the structure exhibits improved strength and rigidity in response to external forces.

SUMMARY OF THE INVENTION

The present invention broadly accomplishes the desired objects by providing a flexible structure comprising at least one deformable resilient pole, and at least one tension web assembly having one or more strut members and coupled to the pole to maintain it under tension in a selected, e.g., generally arcuate, shape. Preferably, the web assembly extends from a first point on the pole to a second point on the pole. More preferably, the distance from the first point to the second point is more than about 50% of the length of a tensioned, arcuately-shaped pole. Even more preferably, at least one web assembly generally extends from one end of the pole to another end of the pole.

Preferably, the flexible structure includes a plurality of tensioned generally arcuately-shaped poles and a plurality of tension webs coupled to the poles by means of hooks, sleeves or other means, such that each pole has at least one tension web associated therewith. The poles may, but not need be, arranged in a crossing pattern having a plurality of intersections, depending on the desired shape of the structure. The web assembly preferably comprises a relatively rigid material, e.g., a material comprising a plurality of tensile fibers oriented to resist undesired deformation of the poles, when subjected to external load forces.

A flexible member may be coupled to and supported by the web assembly to define a sheltered space. The flexible member is preferably a flexible membrane, such as tent fabric.

BRIEF DESCRIPTION OF THE DRAWINGS

Exemplary embodiments of the present invention summarized above are shown in the accompanying drawings wherein.

DESCRIPTION OF THE PREFERRED EMBODIMENT

Figure 1:
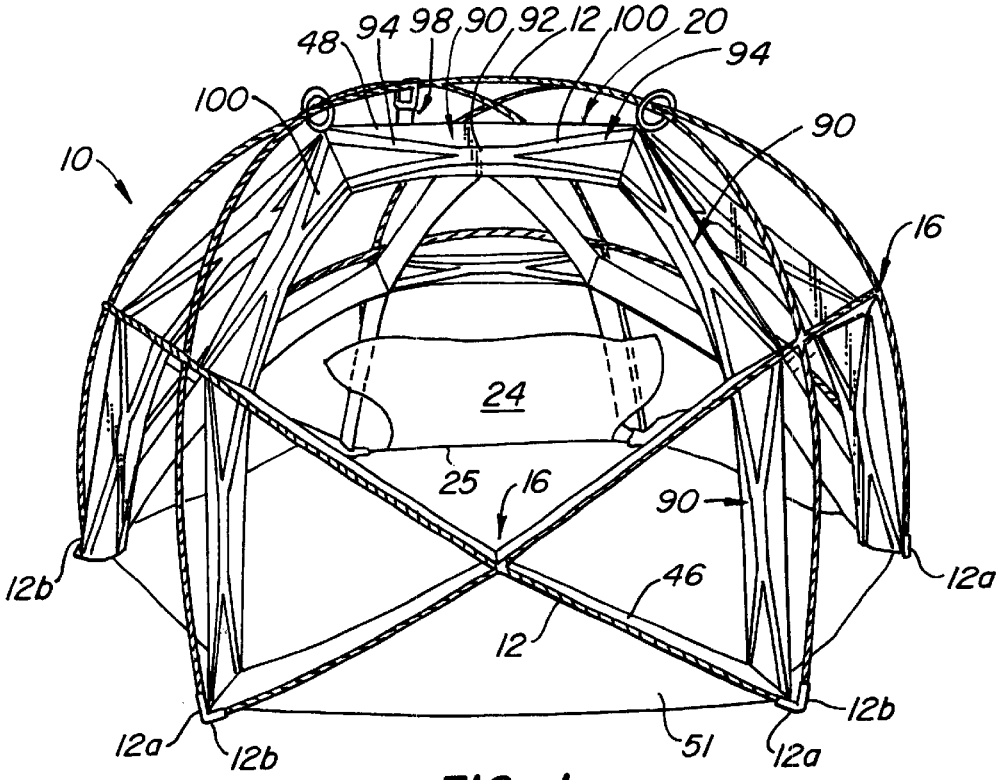
FIG. 1 is a perspective view illustrating one presently preferred embodiment of a flexible structure comprising a plurality of deformable resilient pole elements held under tension in a generally arcuate configuration by a first preferred form of tension web assembly coupled thereto.

Presently preferred embodiments of the invention will now be described in detail with reference to the drawings, wherein similar parts are identified by like reference numerals.

The invention is preferably embodied in a flexible structure, generally illustrated as 10. The flexible structure 10 of the present invention may be used for any suitable purpose, such as a shelter, storage space, dwelling, tent, kite, or the like. A particularly useful application is as a tent and the structures described herein may be referred to from time to time as tents. However, such references are merely exemplary and are not intended to be limiting.

Depending upon the desired shape, volume and usage of the flexible structure 10, the structure may include one or more pole or rod elements 12. For example, an elongated "hoop" style tent structure can be fabricated using a single pole element 12. Alternatively, more complex "dome" type structures will generally employ a plurality of pole elements 12. In its broadest aspect, the scope of the present invention is not dependent on the number of pole elements 12 employed. Thus, the flexible structure 10 may include a plurality of pole elements 12, which may be arranged in any suitable fashion, such as to produce a "vault" shaped or a generally dome-shaped structure, as shown in FIG. 1. Each of the poles 12 is elongated and has termini or terminal ends 12*a* and 12*b*. The poles may be continuous or may be formed in segments. For example, each pole may have multiple segments with cooperating fittings and be held together by well known shock cord techniques.

Figure 17:
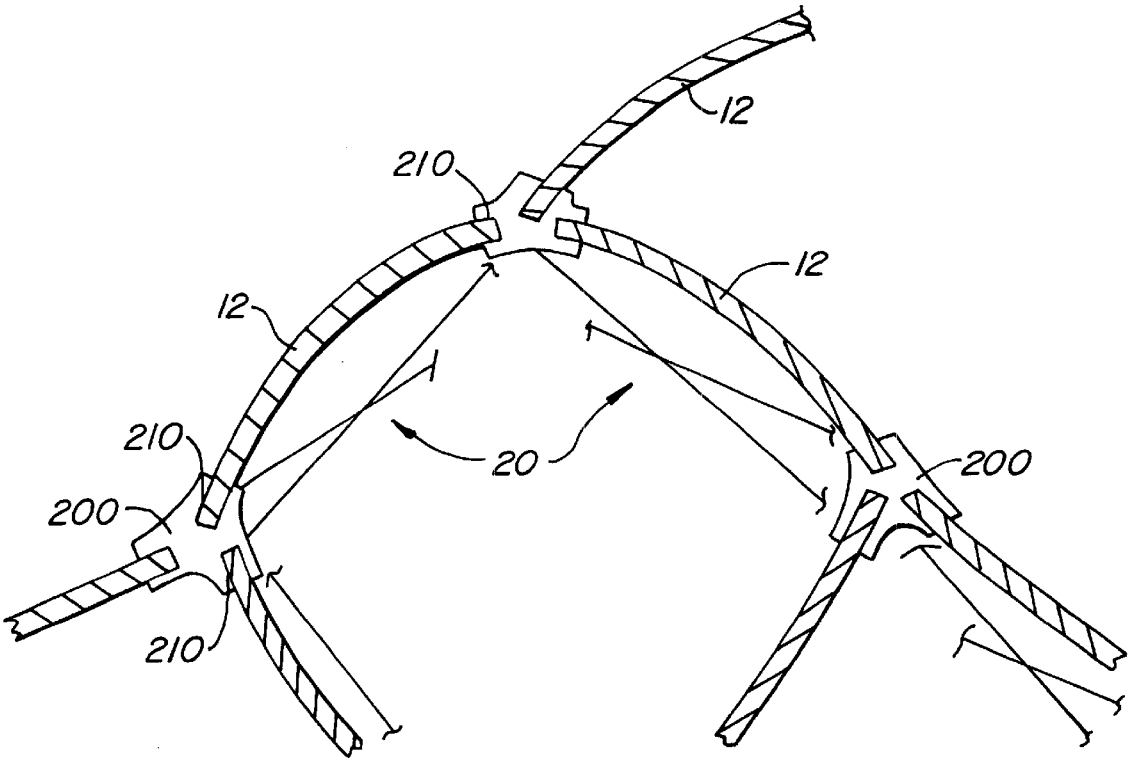
FIG. 17 is a perspective view of a flexible structure comprising yet another presently preferred embodiment, wherein a plurality of deformable resilient pole segments coupled to each other through hubs are maintained in respective selected shapes under tension by another presently preferred form of tension web assembly, partially shown, which is engaged to and between respective hubs.
Figure 18:
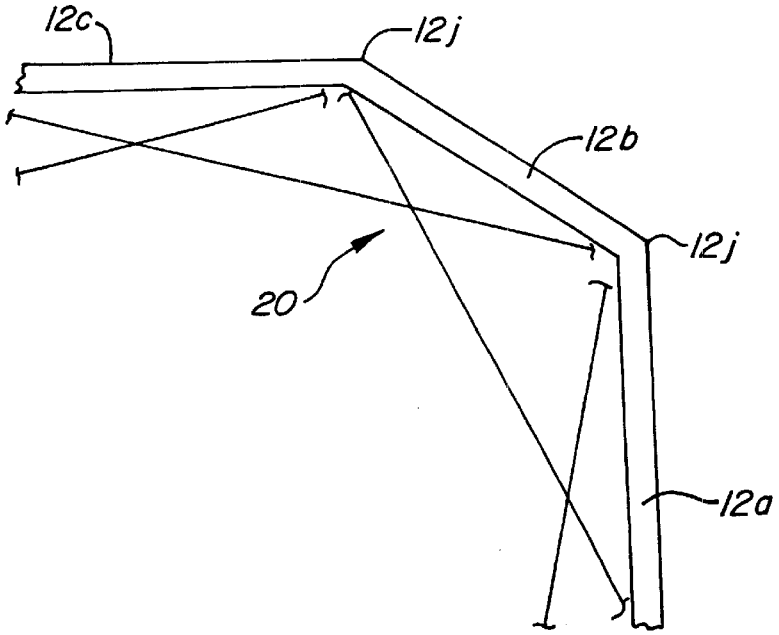
FIG. 18 is a partial side elevational view of a flexible structure comprising still another preferred embodiment, wherein a plurality of deformable resilient pole segments are integrally coupled to each other at angular junctions to define pole elements, wherein the pole segments are angularly disposed with respect to each other, and further wherein another preferred form of tension web assembly, which is partially shown, engages the pole segments in relation to the angular junctions to maintain the poles in selected shapes under tension.

The poles 12 may be arranged in a variety of configurations. The terminal ends 12*a* and 12*b* of the tensioned poles 12 will generally terminate in a common plane and may be distributed around the common plane if desired to produce a plurality of pole crossings as best shown in FIG. 1. The terminal ends 12*a* and 12*b* (see FIGS. 7 and 8) may be supported by a pad 15, or the like, to prevent the terminal ends 12*a* and 12*b* from entering a support base or ground 51 when the flexible structure 10 is functioning as a dwelling, such as a tent. When the plurality of poles 12 are arranged to produce the generally dome-shaped structure of FIG. 1, the poles 12 may be disposed in a crossing fashion at a plurality of intersections 16. Alternatively, as shown in FIG. 17, a plurality of tensioned poles 12 may be intercoupled through hubs 200. Each such hub 200 preferably includes openings 210 for receiving ends of two or more tensioned poles 12, depending on the desired shape of the structure. Also alternatively, as shown in FIG. 18 a plurality of pole segments 12*a*, 12*b*, 12*c*, etc. may be integrally bound or coupled to each other at angular junctions 12*j* to produce a quasi-arcuately-shaped pole 12 wherein the pole segments 12*a*, 12*b*, 12*c*, etc. are angularly disposed with respect to each other.

The flexible pole elements 12 may be any of the well known pole types typically used in known tent structures. These include single and multi-piece poles made of aluminum, fiberglass, graphite, or other suitable materials which are deformable and resilient.

A key aspect of the flexible structure 10 of the present invention is the provision of a tension web assembly 20. The tension web assembly 20 may take various forms as will be described in detail hereinafter. The tension web assembly 20 is preferably coupled to one or more pole elements 12 by any of a variety of means, as will also be described in detail hereinafter. The tension web assembly 20 preferably functions to maintain a pole element or elements to which it is coupled in a selected shape under tension. For example, as shown in FIG. 1, tension web 20 is coupled to pole elements 12 and maintains them under tension in a generally arcuate shape. Of course, those skilled in the art will realize that other pole shapes are also possible, depending upon the material and lengths of the poles, the relative length of the tension web, and other factors. For example, various arcuate configurations having different radiis are possible. Other configurations, for example as shown in FIGS. 2–4, 17, and 18 are also possible.

Depending on the desired use of the flexible structure 10, the tension web 20 may have secured or coupled thereto a flexible member 24, which may be conventional flexible tent material for example, as shown in FIGS. 1–4, 8, 9A, 9B, 10A, 11A, 11B, 13 and 20. Alternatively or additionally, although not shown, a covering could be placed over the structure. The flexible member 24 may be secured or coupled to the tension web 20 in numerous different ways, some of which are described in further detail hereinafter. The flexible member 24 will preferably define a sheltered space for any desired use. "Sheltered" as used herein does not necessarily mean the space must be completely enclosed or even that it must provide complete shelter from external elements. However, the sheltered space should at least be usable for the intended purpose of the structure.

The flexible member 24 includes marginal edges 25 (see FIG. 1) that typically will be co-planar with the terminal ends 12*a* and 12*b* of poles 12. The flexible member 24 may or may not include an integral portion or be coupled to a portion in the plane of the poles, e.g., the floor plane. The flexible member 24 may be any suitable membrane, skin, film, fabric or the like, such as a plastic sheet material of polyethylene, polypropylene, vinyl and the like, or a woven fabric such as cotton, nylon, or polyester, or any other material, including a material having the characteristics of being stretchable in multiple directions. When the flexible structure 10 is functioning as a tent, the flexible member 24 will preferably be a suitable tent fabric.

Because of its unique construction, wherein a tension web 20 maintains the pole elements 12 under tension in a selected shape, the flexible structure 10 of the present invention exhibits improved strength and rigidity compared to prior flexible structures wherein the flexible membrane 24 itself was wholly or substantially responsible for tensioning the pole elements.

Thus, attention is now turned to a more detailed description of the unique tension web assembly 20 of the invention. The tension web assembly 20 may be embodied in numerous alternate configurations to provide tensioning of the poles and to impart strength and rigidity to the structure. A number of presently preferred embodiments are identified and described herein below.

As best shown in FIG. 1, each portion of web assembly 20 is preferably aligned with an associated pole 12 and extends from one end (e.g., terminal end 12*a*) of its associated pole 12 to the other (e.g., terminal end 12*b*) While FIG. 1 depicts a portion of the web assembly 20 extending substantially from one end of the pole 12 to the other end of the pole, the spirit and scope of the present invention also includes a tension web assembly 20 extending over less than about 50%, or over more than about 50%, of the value of the entire length extending along and/or spanning the arcuate length of the tensioned pole. In multi-pole configurations, each pole 12 preferably has a portion of the web assembly 20 associated therewith. However, there may be configurations where sufficient strength and rigidity are achieved by coupling the tension web to less than all of the poles, for example to selected poles only.

Figure 2:
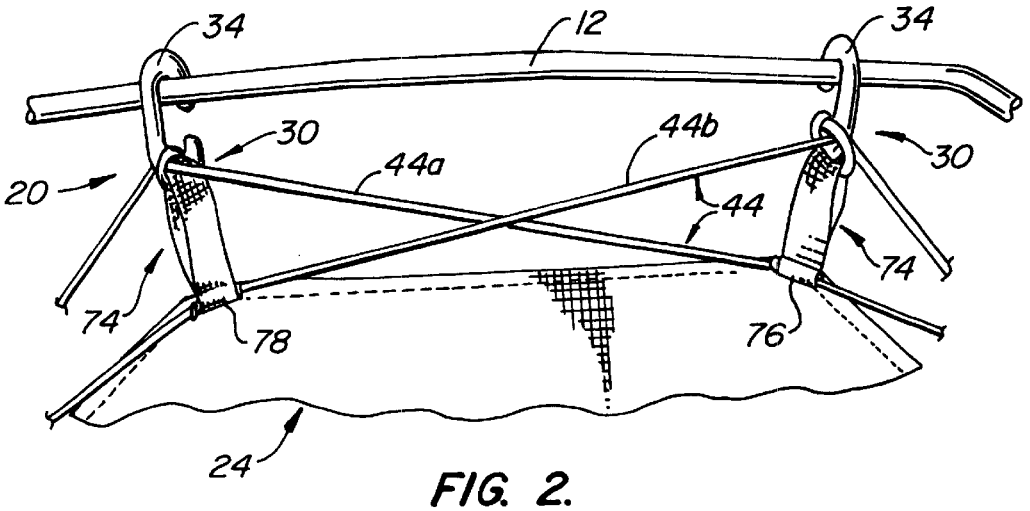
FIG. 2 is a partial side elevational view illustrating another presently preferred embodiment comprising at least one deformable resilient pole element maintained under tension in a selected shape by a second preferred form of tension web assembly, which is coupled thereto and to a flexible membrane, to define a sheltered space.
Figure 8:
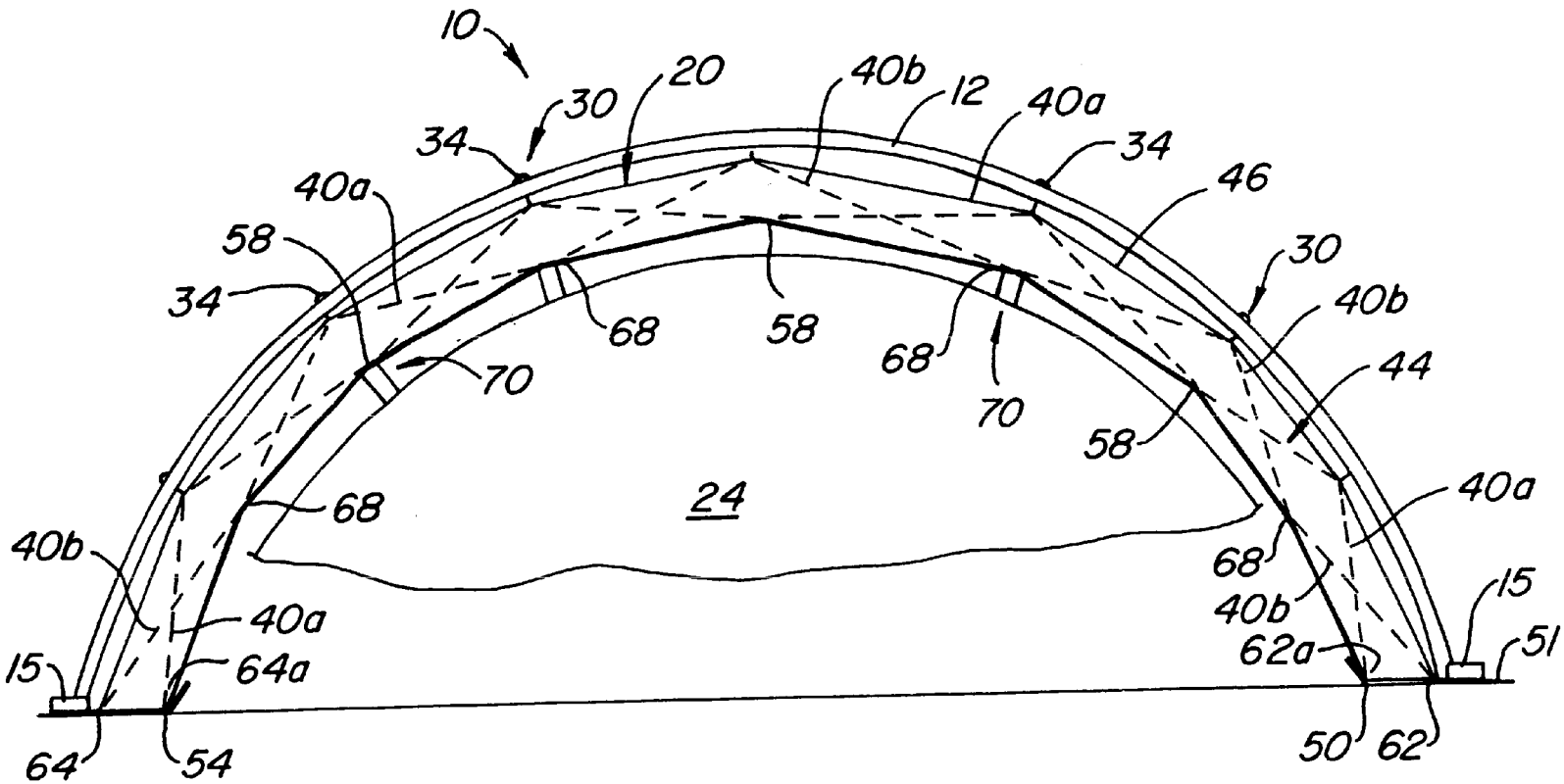
FIG. 8 is a front elevational view of a flexible structure comprising yet another presently preferred embodiment, wherein at least one deformable resilient pole element is maintained in a generally arcuate shape under tension by yet another preferred form of tension web assembly, comprising a low stretch, sheet-like web coupled to the pole at regular intervals, and coupled to an underlying flexible member to define a sheltered space.

In preferred embodiments depicted in FIGS. 2 and 8, the tension web assembly includes at least one hook assembly, generally illustrated as 30, and preferably a plurality of hook assemblies 30 for coupling the tension web to the tensioned pole 12 at a plurality of spaced locations. In the embodiment of the invention illustrated in FIG. 8, each hook assembly 30 includes a hook 34 for engagement to the tensioned pole 12. The hook assembly couples the tension web assembly 20 to the pole 12 and communicates the tension force of the tension web to the pole. In the particular embodiment of FIG. 8, the tension web comprises one or more contiguous tension members 46 and the hooks attach to an upper edge of 46, which may be a low stretch plastic or fabric material. In this embodiment the tension vectors that result from coupling the tension member 46 to the pole extend generally along dotted lines 40*a* and 40*b*. Preferably the tension member 46 will be secured to the ground or other fixed surface at opposite ends by stakes 50 and 54 or other suitable means. The width of the tension member 46 will depend on a variety of parameters including the materials selected for the web member and the poles, the degree of rigidity and strength desired, and possibly the size of the sheltered space to be defined by underlying membrane 24. Alternatively, the tension web may comprise a pair of tension members 44, such as cords, ropes, or the like, as shown in FIG. 2, which are identified individually as 44*a* and 44*b*. If separate tension members 44*a* and 44*b* are employed, they may be contained within a tension sleeve (not shown). In the embodiment of FIG. 2, they are exposed. If separate tension members 44 are employed in the embodiment of FIG. 8, one tension member preferably extends under tension in a direction generally along dotted line 40*a* from a point 62*a* near one distal end of the pole element 12, where it is affixed or bound to the sleeve or alternatively to the ground 51, to a diametrically opposed point 64*a* near the opposite distal end of the pole element 12, where it is also affixed or bound to the sleeve or to the ground 51. In extending from point 62*a* to 64*a*, the tension member preferably connects to every other hook 34. Between points of connection to alternating hooks 34, the tension member preferably attaches to a sleeve at intermediate points 58.

The second tension member preferably extends in a manner similar to the first tension member. More specifically, the second tension member extends under tension in a direction generally along dotted line 40*b* from point 62 near one distal end of pole element 12 where it is affixed or bound to a sleeve or to ground 51, to a point 64 which is diametrically opposed to point 62 near the opposite distal end of pole element 12, where it is likewise connected to either a sleeve or ground 51. In extending from point 62 to point 64, the second tension member preferably connects to every other hook 34 in an alternating arrangement with the first tension member. Between points of connection to alternating hooks, the second tension member preferably connects to a sleeve at intermediate points 68. As thus arranged, the first and second tension members preferably criss-cross each other between any pair of hooks 34, just as tension vectors would in the case of a contiguous tension member, thus producing a tension web which maintains pole element 12 in a generally arcuate shape under tension.

In the embodiment of the invention illustrated in FIG. 2, the tension members 44*a* and 44*b* are similarly preferably arranged in a criss-crossing arrangement and engage alternating hooks 34 coupled to the tensioned pole element 12. In this particular embodiment, the respective hooks 34 in turn engage connecting members or loops 74. The tension members 44*a* and 44*b* engage the lower parts of alternating hooks 34 and the lower parts of alternating loops 74, for example at points 76 and 78.

It will be apparent to those skilled in the art that while two tension members 44*a* and 44*b* are shown in the exemplary embodiment of FIG. 2, a single member or more than two members could be used. It will also be apparent that while tension members 44*a* and 44*b* are shown extending substantially from one distal end of pole element 12 to the opposite distal end, one or both members could extend a shorter distance, depending on the desired shape and application, among other things. Additionally, it will be apparent that tension vectors in a contiguous tension member as illustrated in FIG. 8 will provide substantially similar functionality as individual tension members.

In the preferred embodiments shown in FIGS. 2 and 8, a flexible member 24 may be attached underlying the tension web assembly, if desired, to define a sheltered space. In particular, in the embodiment of FIG. 2, the flexible member 24 may suitably be attached at a plurality of points 76, 78, etc., for example by sewing to the bottom of loops 74. As shown, a miniature sleeve or loop may be formed thereby for tension member 44*a* or 44*b* to pass through. In the embodiment of FIG. 8, the flexible member 24 may be attached to tension web 20 by any suitable means including suitable connector straps 70. Alternatively, the tension web 20 could be connected directly to the flexible member 24, for example via a stitched seam, or may even be formed integrally therewith.

It will be apparent to those skilled in the art that flexible structure 10, for example in the form shown in FIGS. 2 and 8, may or may not include flexible member 24. Flexible member 24 may be omitted if desired for a particular application because it is not necessary in order to maintain the pole elements 12 under tension as in prior flexible structures. Thus, the exposed pole structure may stand alone, for example as shown in FIG. 1, or alternatively a suitable covering may be placed over the top of the pole structure.

Figure 3:
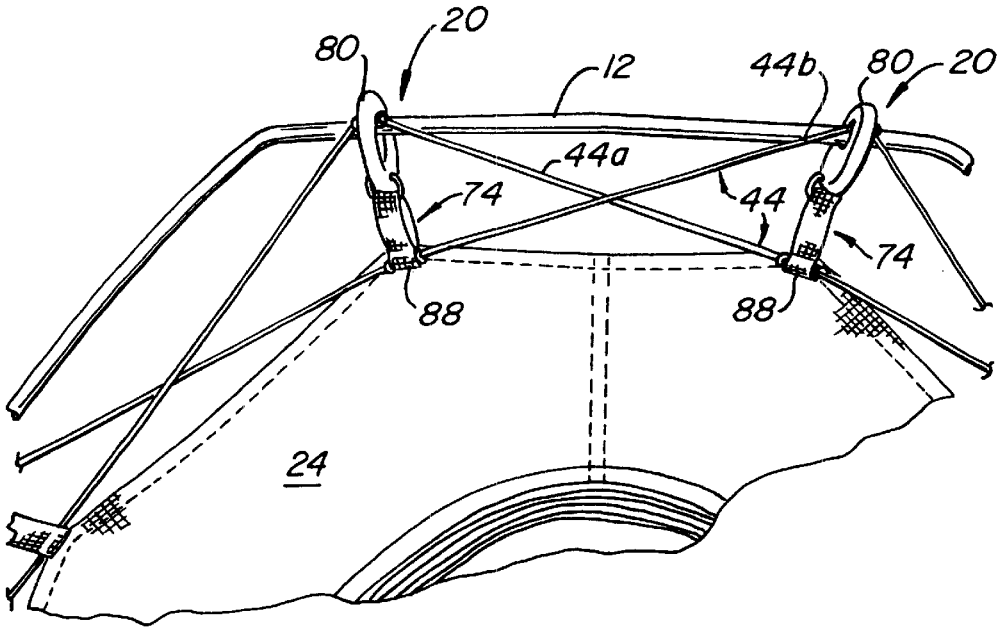
FIG. 3 is a partial side elevational view illustrating yet another presently preferred embodiment of a flexible structure, similar to that of FIG. 2, comprising another preferred form of tension web assembly coupled to a deformable resilient pole to maintain the pole under tension in a selected shape, and coupled to a flexible member to define a sheltered space.
Figure 4:
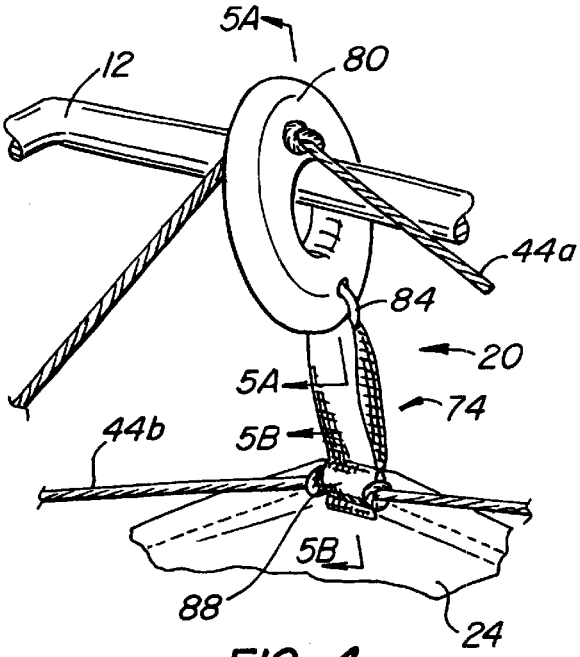
FIG. 4 is an enlarged perspective view of a preferred form of ring member shown in FIG. 3 for coupling a tension web assembly to a deformable resilient pole and to an underlying flexible member.
Figure 5A:
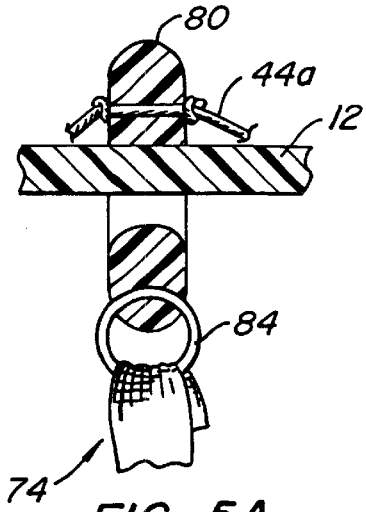
FIG. 5A is a vertical sectional view taken in the direction of the arrows and along the plane of line 5A—5A in FIG. 4.
Figure 5B:
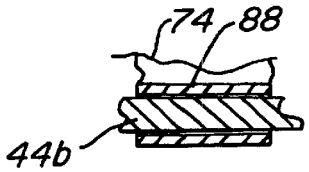
FIG. 5B is a vertical sectional view taken in the direction of the arrows and along the plane of line 5B—5B in FIG. 4.

Referring now to FIGS. 3–5B, another presently preferred embodiment of the tension web assembly 20 will be described. This embodiment is similar to the embodiment of FIG. 2 in that it also employs exposed, criss-crossing tension members 44*a* and 44*b*. However, in place of hooks 34, rings 80 are employed to couple the tension web to pole element 12 and to optional flexible member 24. As best shown in FIG. 3, a plurality of rings 80 are slidably disposed on pole element 12. Each ring 80 preferably has a lower ring 84 associated therewith for engaging a loop 74 as shown in detail in FIGS. 4 and 5*a*. Each loop 74 is preferably either coupled to or formed with a sleeve 88. In this embodiment of the invention, tension members 44*a* and 44*b* alternately pass through the upper part of rings 80 and the lower part of loop 74 through sleeves 88, as best shown in FIGS. 3, 4 and 5B. Alternatively, tension members 44*a* or 44*b* could pass through separate holes in the lower portions of rings 80 or even through the same openings as lower rings 84. This may provide improved structural stability in some configurations. If desired, hooks, knots, or other mechanisms may be used as shown in FIGS. 4 and 5A, to prevent tension members 44*a* and 44*b* from sliding relative to rings 80 and sleeves 88.

As with the exemplary embodiment of FIG. 2, fewer or more tension members may be employed as desired. Moreover, if desired, a flexible member 24 may be coupled to the tension web assembly 20, for example at sleeves 88. The flexible member 24 may be coupled to the tension web assembly 20 by any suitable means including stitching or adhesive.

Note that in this particular example, pole 12 is not maintained in an arcuate shape, but is seen to have relatively sharper bends at specific locations. The present invention is not limited by any specific pole shape or configuration.

Figure 7B:
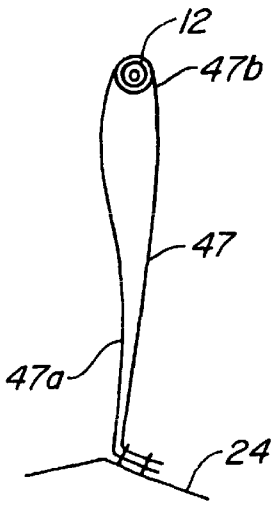
FIG. 7B is a vertical sectional view taken in the direction of the arrows and along the plane of line 7B—7B in FIG. 7A.
Figure 7A:
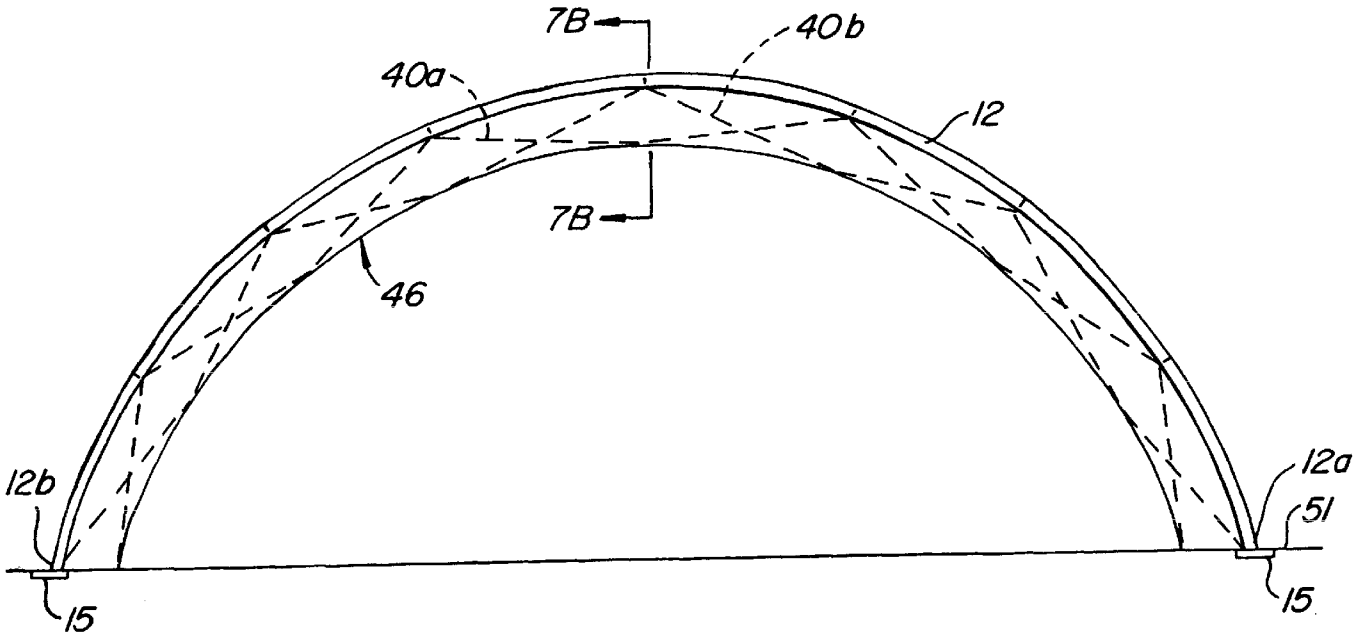
FIG. 7A is a front elevational view of a flexible structure comprising yet another presently preferred embodiment wherein at least one deformable resilient pole element is disposed within a sleeve and is maintained in a generally arcuate shape under tension by another presently preferred form of tension web assembly coupled thereto.

Yet another preferred embodiment of the invention is shown in FIGS. 7A and 7B. This embodiment is similar to the embodiment of FIG. 8 in that the tension web assembly may either define tension vectors extending generally in the direction of dotted lines 40*a* and 40*b* in a contiguous tension member 46, or include separate crisscrossing tension members extending generally in the direction of dotted lines 40*a* and 40*b*, contained within a tension sleeve 47. In this embodiment, when a contiguous tension member 46 is employed, the pole element 12 is preferably contained and slides freely within an upper portion of the tension member 46 rather than the tension web being coupled to the pole element 12 by hooks 34 as in FIG. 8, or by other means, e.g., rings, as in FIG. 3, etc. Thus in this embodiment, the tension member 46 has a sleeve 47 formed therewith, preferably at the top. The sleeve 47 may be formed in any suitable manner. For example, as shown in FIG. 7B, the sleeve 47 may be formed by an enclosed loop of fabric or other material sewn or bonded to the top of tension member 46. Alternatively, the sleeve may be formed integrally with the material forming the tension member 46, for example by folding over a length of fabric extending above the tension member 46 and sewing or otherwise bonding the free end to the top of the tension member 46 along its length.

In either alternative, the material for the upper sleeve 47*b* should be selected to allow the pole element to slide freely. If separate tension members 44*a* and 44*b* are used, they may be coupled to the pole element 12 or to an upper portion 47*b* of the sleeve 47 in any suitable fashion. In one alternative, each tension member may be provided with a plurality of rings at spaced locations corresponding to desired coupling locations with pole element 12. The rings can be extended into the upper sleeve portion 47*b* so that pole element 12 can slide through the rings freely. Another alternative is to attach the tension members 44*a* and 44*b* to an upper portion 47*b* of the sleeve 47 at selected locations by stitching, adhesive bonding or any other suitable means.

Persons skilled in the art will realize that either less or more than two tension members may be employed depending on the needs and goals of the particular design. Similarly, other pole shapes and configurations may be employed. Further, the tension web assembly may extend less than substantially all the way between the two distal ends of the tensioned pole element. Also, if desired, a flexible member 24 (not shown in FIG. 7A) may be attached or coupled to the bottom of the tension member 46 or sleeve 47 at selected locations and by any suitable means to define a sheltered space.

Figure 6C:
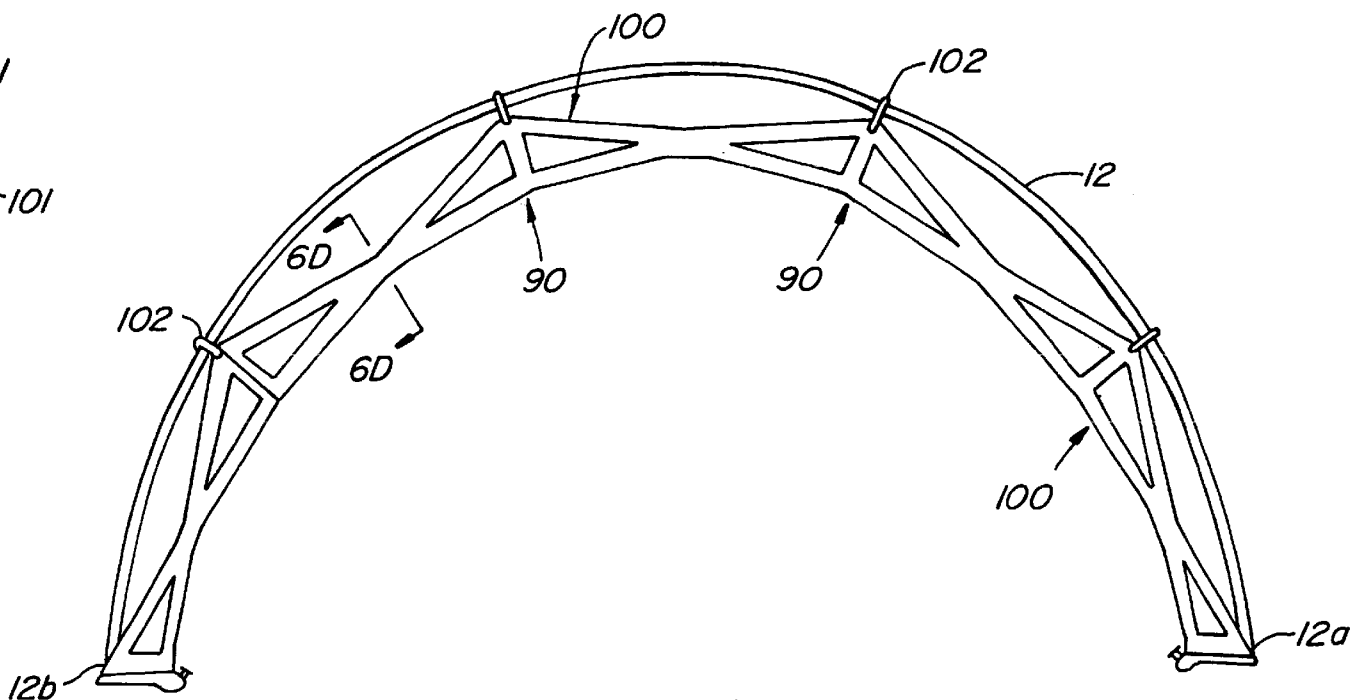
FIG. 6C is a front elevational view illustrating another presently preferred embodiment comprising at least one deformable resilient pole maintained in a generally arcuate shape under tension by another preferred form of tension web assembly defined by a plurality of geometrically interconnected bands extending substantially from one end of the pole to another.
Figure 6A:
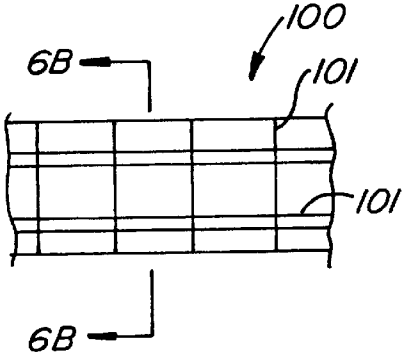
FIG. 6A is a top plan view illustrating a presently preferred embodiment of a portion of a fibrous band for forming a tension web assembly.
Figure 6B:
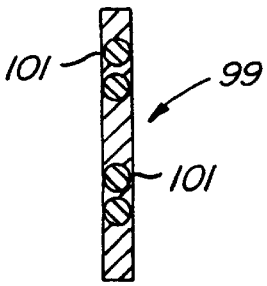
FIG. 6B is an enlarged vertical sectional view taken in the direction of the arrows and along the plane of line 6B—6B in FIG. 6A., Illustrating the orientation of a plurality of tensile fibers within the band.
Figure 6D:
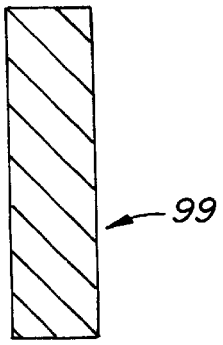
FIG. 6D is an enlarged vertical sectional view taken in the direction of the arrows and along the plane of line 6D—6D in FIG. 6C.

FIGS. 1 and 6A–6F depict yet another presently preferred embodiment of a flexible structure using a tension web assembly 20. In this embodiment, the tension web assembly 20 comprises a plurality of tension web members 90. Tension web members 90 may be integrally formed. Alternatively, adjacent tension web members 90 may be interconnected by stitching or other bonding to form tension web assembly 20. The tension web 20 thus formed may be exposed as shown in FIG. 6C, or may be enclosed in a sleeve 48 as best shown in FIG. 1. Whether exposed or enclosed within a sleeve, the tension web assembly 20 (or the sleeve) is preferably coupled to the pole element 12 at a plurality of spaced locations associated with the locations of the tension web members 90. Coupling may be by any suitable coupler or connector generally illustrated as 98 including rings, hooks, buckles or the like. As further best shown in FIG. 1, the tension web assembly 20 is generally preferably aligned in a substantially co-planar relationship with associated poles 12.

Preferably, the tension web members 90 are formed in a geometric shape or configuration selected for strength in maintaining pole elements 12 in their selected shape under tension. In the particular embodiment shown, the web members 90 are formed in a sort of triangular shape and connected end to end. Also in one particular embodiment, best shown in FIG. 6C, each triangle is "bifurcated" by a vertical strip. While the vertical strip is not strictly necessary, it can be useful in some configurations to provide additional strength and to assist in coupling the tension web 20 to pole element 12 and to an underlying flexible member 24 (if desired). It can also be useful in interconnecting tension web members 90 in three dimensions, as shown in FIG. 1. The tension web members 90 may be interconnected in any suitable fashion including stitched seams, studs, or rivets, adhesive bonding, or the like. In this particular embodiment, the tension web members 90 comprise interconnected tension web bands 100. The particular thickness, width and length dimensions of the tension web bands 100 will depend on the particular pole shape and configuration, tension web assembly configuration, pole material, and desired strength and tension parameters. Preferably, each tension web member 90 is coupled to a tensioned pole element, with which it is associated, at a plurality of spaced points by connectors 102, which may be rings, hooks, sleeves or the like, all as previously described herein, which allow the pole elements 12 to slide relative to the tension web 20. Thus, for example, the poles 12 of FIG. 1 could be encased in pole sleeves such as shown in FIG. 7B, and the tension web members 90 or sleeves 48 could be coupled or attached thereto. The particular placement of the connecting rings, hooks etc., will depend on the particular design of the structure 10, but may be placed so as to couple one or more tension members 90 to one or more pole elements 12.

Tension web bands 100 (as well as all other variations of the tension web assembly 20 described herein) are preferably formed of a low stretch, strong, high tensile strength material in order to impart strength and rigidity to the structure and to resist deformation of the poles when external forces are applied. Thus, the tension web will preferably be formed of a relatively low stretch, non-fibrous material, such as a molded or extruded plastic. Suitable materials may include polypropylene and high density polyethylene. Alternatively the tension web may be formed of a fibrous material, provided it is one with relatively high tensile strength, especially high directional tensile strength. Suitable materials may include heavy duty nylon, woven polyethylene bands, or woven kevlar or dacron. A composite or laminate material having appropriately oriented tensile strength is also suitable. Such materials may include a polyester sheath or laminate encasing woven kevlar fibers or a high density polyethylene sheath or laminate encasing woven polyethylene or polypropylene bands.

More particularly, tension web bands 100 are suitably formed of a high density, woven, laminated polyethylene material sold under the product name Tuff-Tarp by Lewis Hyrnan & Co., Inc. of Carson, California. A fibrous material suitable for the tension web bands 100 is high tensile strength dacron sold commercially by BSS Corporation of Howl & Bainbridge under the trademark BSS Performance Dacron and having product name "Blade-HT" and "Warp-Oriented."

Figure 6E:
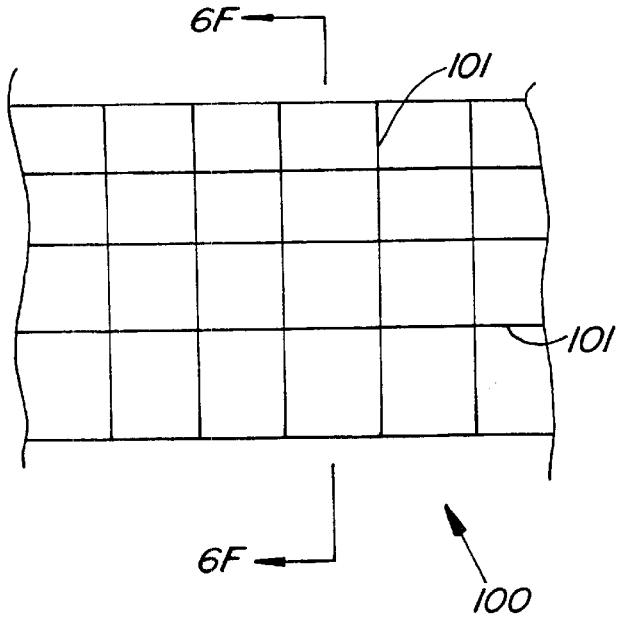
FIG. 6E is a top plan view of another preferred embodiment of a band suitable for forming a tension web assembly.
Figure 6F:
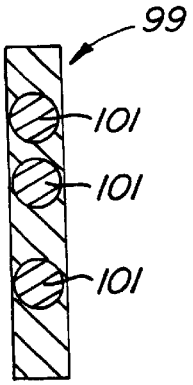
FIG. 6F is an enlarged vertical sectional view taken in the direction of the arrows and along the plane of line 6F—6F in FIG. 6E.

In the particular case where the tension web is composed of a fibrous material, such as a woven material, it is preferred that the fibers 101, as shown in FIG. 6E, be oriented so as to resist deformation of the poles 12 when an external load/force (e.g., wind, snow, etc.) is placed either directly on the poles 12 or indirectly thereon by application to a connected flexible member 24 supported by the pole(s) 12. Since the web bands (as well as other forms of tension members previously described) will couple to the poles at points forming geometric chords, and will thus tension the poles at least generally along the chords, it is preferred the tensile fibers be oriented such that the material exhibits maximum resistance to stretching in the direction of the chords. Standard woven nylon materials, such as nylon tent fabric, will generally not be suitable unless properly oriented because they tend to be relatively stretchy along the chords (i.e., the bias). Proper orientation of such material can be achieved for example by cutting into strips with the warp oriented generally along the geometric chord. The tensile fibers 101 when properly oriented will act to provide tensile stiffness to counteract the bending movement of the pole(s) 12 when a load/force is placed on the poles or flexible member 24.

Figure 10A:
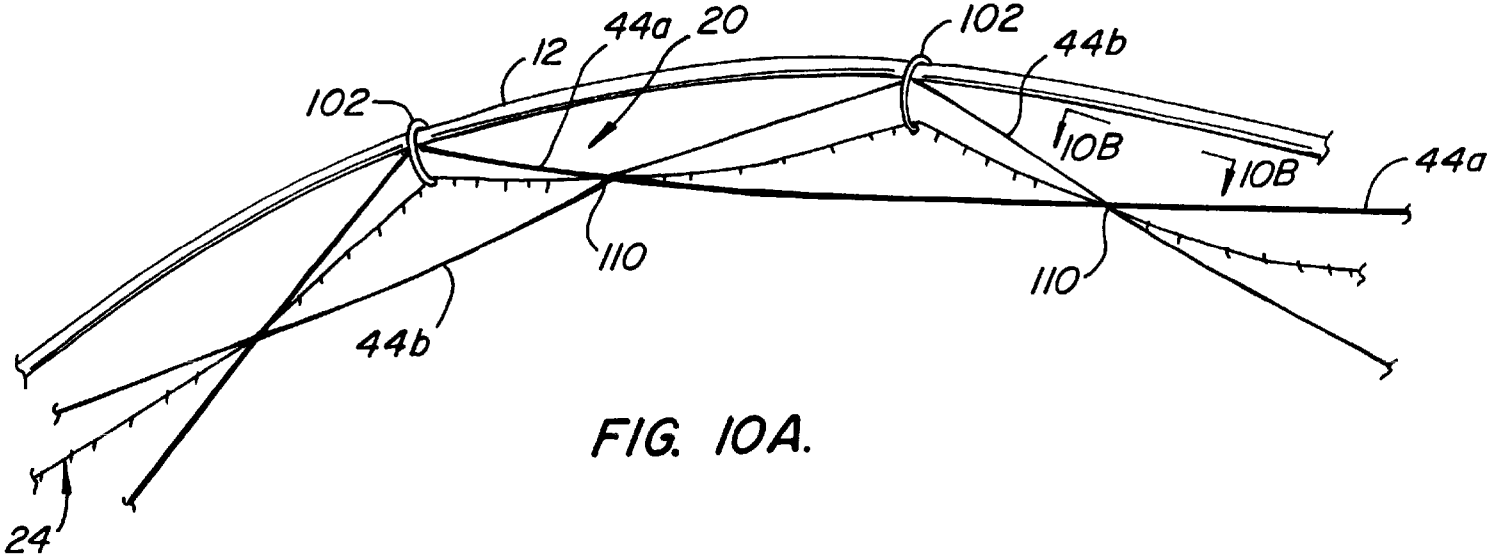
FIG. 10A is a partial side elevational view of a flexible structure comprising yet another presently preferred embodiment, wherein at least one deformable resilient pole element is maintained in a generally arcuate shape under tension by yet another presently preferred form of tension web assembly, which passes through openings in and supports an underlying flexible member defining a sheltered space.
Figure 10B:
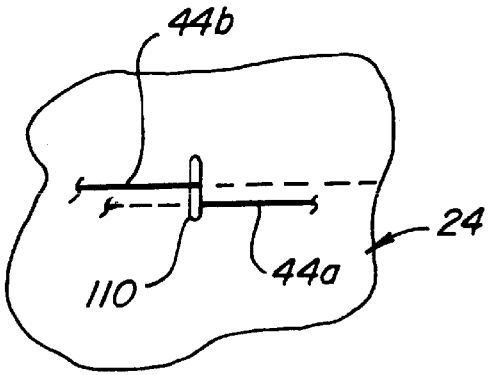
FIG. 10B is a horizontal view taken in direction of the arrows and along the plane of line 10B—10B in FIG. 10A.

Referring now to FIGS. 10A, and 10B, still another presently preferred embodiment of the present invention is illustrated. In this embodiment, the tension web assembly 20 is seen to partly extend through a flexible member 24, which it supports. More specifically, and as best shown in FIG. 10A, tension members 44*a* and 44*b* are arranged in alternately criss-cross fashion as previously described. However, in this embodiment, tension members 44*a* and 44*b* also pass through openings 110 in a flexible member 24 (see FIG. 100). Tension members 44*a* and 44*b* are coupled to pole elements 12 via connectors 102 such as previously described. In addition, connectors 102 also directly engage flexible member 24 at a plurality of spaced apart locations.

Figure 11A:
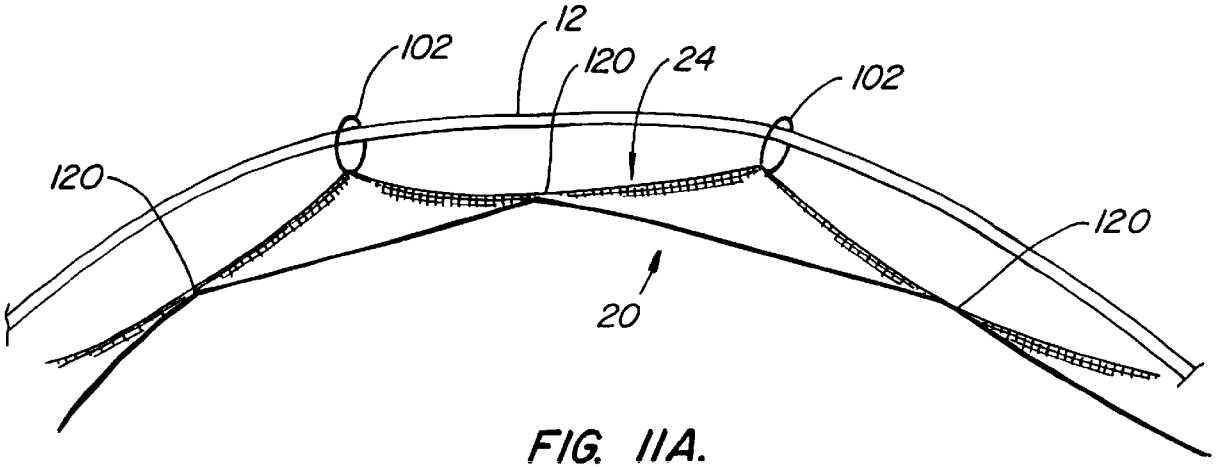
FIG. 11A is a partial side elevational view of a flexible structure comprising yet another presently preferred embodiment, wherein at least one deformable resilient pole element is maintained in a generally arcuate shape under tension by another preferred form of tension web assembly comprising a low stretch element formed within an underlying flexible member that defines a sheltered space, and a low stretch member integrally formed with the flexible member.
Figure 11B:
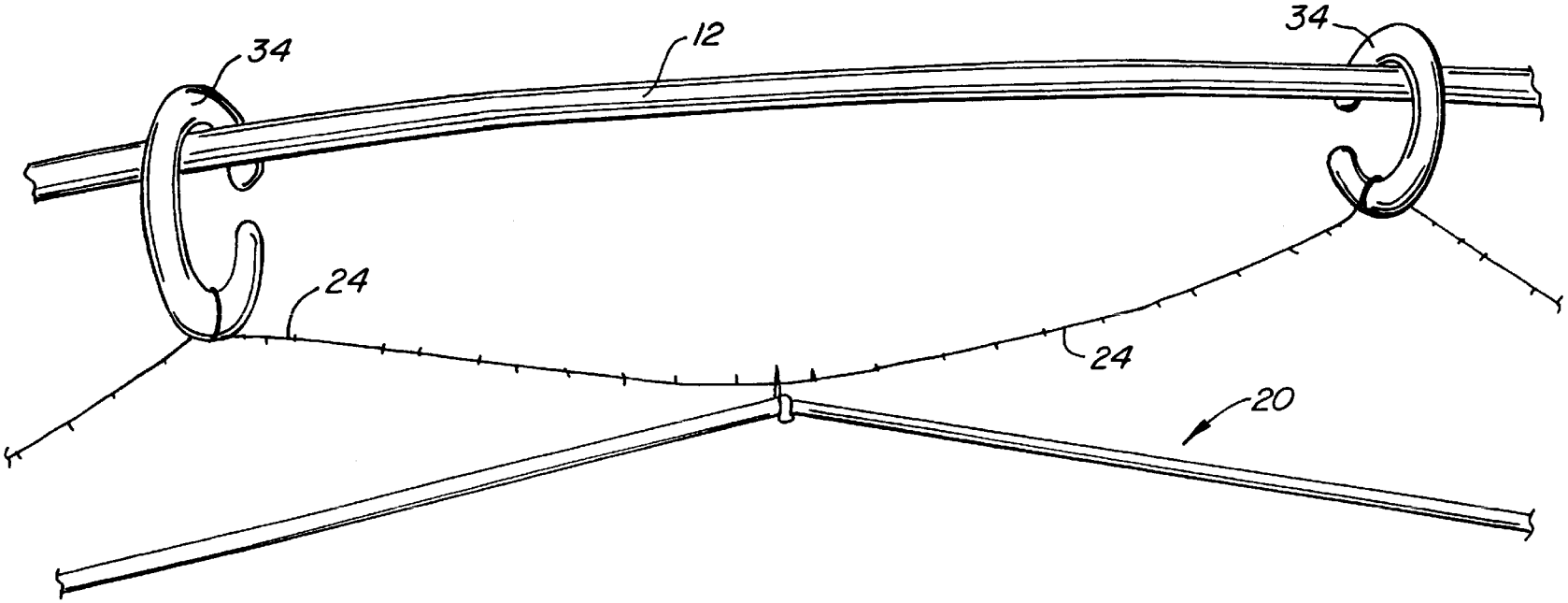
FIG. 11B is an enlarged partial side elevational view of the embodiment depicted in FIG. 11A.
Figure 13:
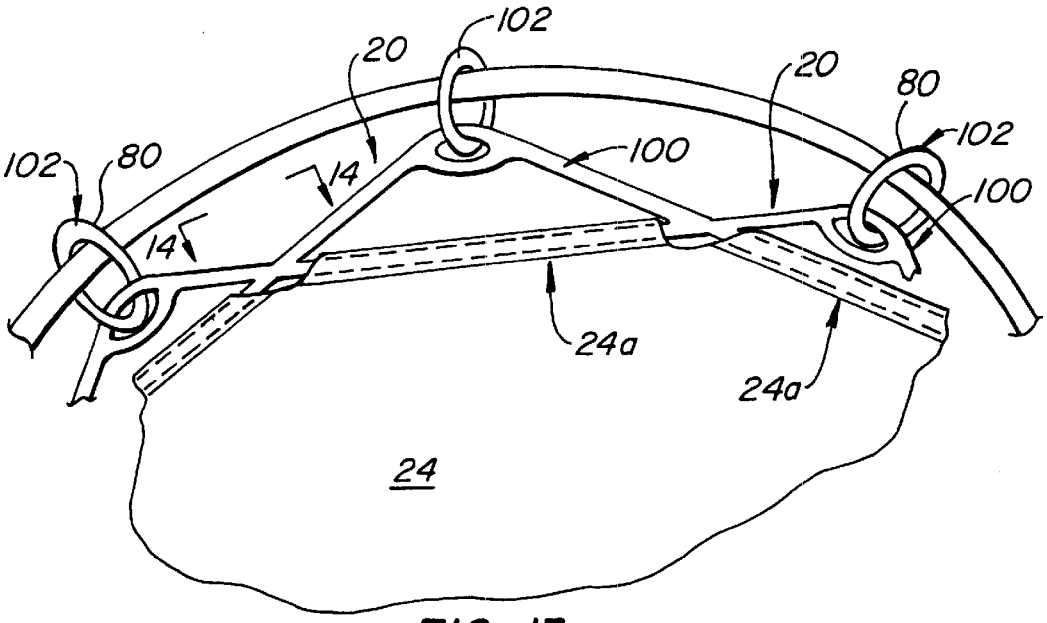
FIG. 13 is a partial side elevational view of a flexible structure comprising yet another presently preferred embodiment, wherein at least one deformable resilient pole element is maintained in a generally arcuate shape under tension by yet another presently preferred form of tension web assembly, comprising a plurality of tension cords coupled to the pole via rings and to an underlying flexible member that defines a sheltered space by passing through peripheral seam pockets therein.
Figure 14:
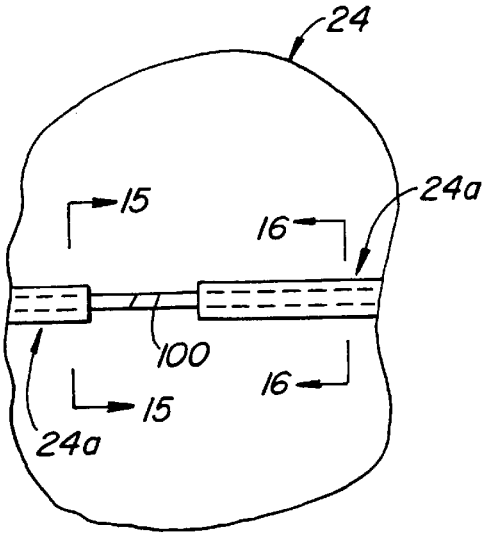
FIG. 14 is a horizontal view taken in the direction of the arrows and along the plane of line 14—14 in FIG. 13.
Figure 15:
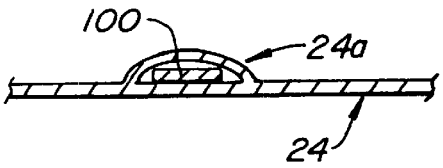
FIG. 15 is a vertical sectional view taken in the direction of the arrows and along the plane of line 15—15 in FIG. 14.
Figure 16:
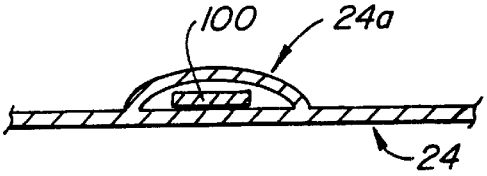
FIG. 16 is a vertical sectional view taken in the direction of the arrows and along the plane of line 16—16 in FIG. 14.

FIGS. 11A and 11B illustrate a further variation of the embodiment of FIGS. 10A and 10B. In this embodiment, a flexible member 24 is directly coupled to connectors 102 at a plurality of spaced locations. In this particular embodiment, the member 24 is preferably constructed of a material tensilely strong enough to function as part of the tension web, at least in the vicinity of the poles. For example, the member 24 could be provided with a low stretch material insert in the vicinity of the pole, or with a heavy, low stretch seam insert. To provide adequate stiffness and strength, a tension web assembly 20 is connected on the inside surface of the flexible member 24 at a plurality of spaced points 120. Together, the upper part of the web, which is integral with the member 24, and the lower part of the web assembly 20 possess sufficient tensile strength to maintain poles 12 in their desired shape under tension.

FIGS. 13–16, illustrate yet another preferred embodiment wherein a tension web assembly 20 includes both an outer web and an inner web, which is formed as part of a flexible member 24. In this embodiment, flexible member 24 is provided with seams of a low stretch, flexible tension web material 24*a*, or alternatively sleeves or pockets wherein low stretch web bands 100 are sewn-in. This comprises an inner tension web. The outer tension web comprises web bands 100, which respectively, alternately are attached to connectors 102 or rings 80 in an alternating fashion. The bands 100 of the outer tension web are preferably fused, bar tacked, or otherwise fixedly connected to the seams or bands 100 of the inner web to form the tension web 20.

Figure 9A:
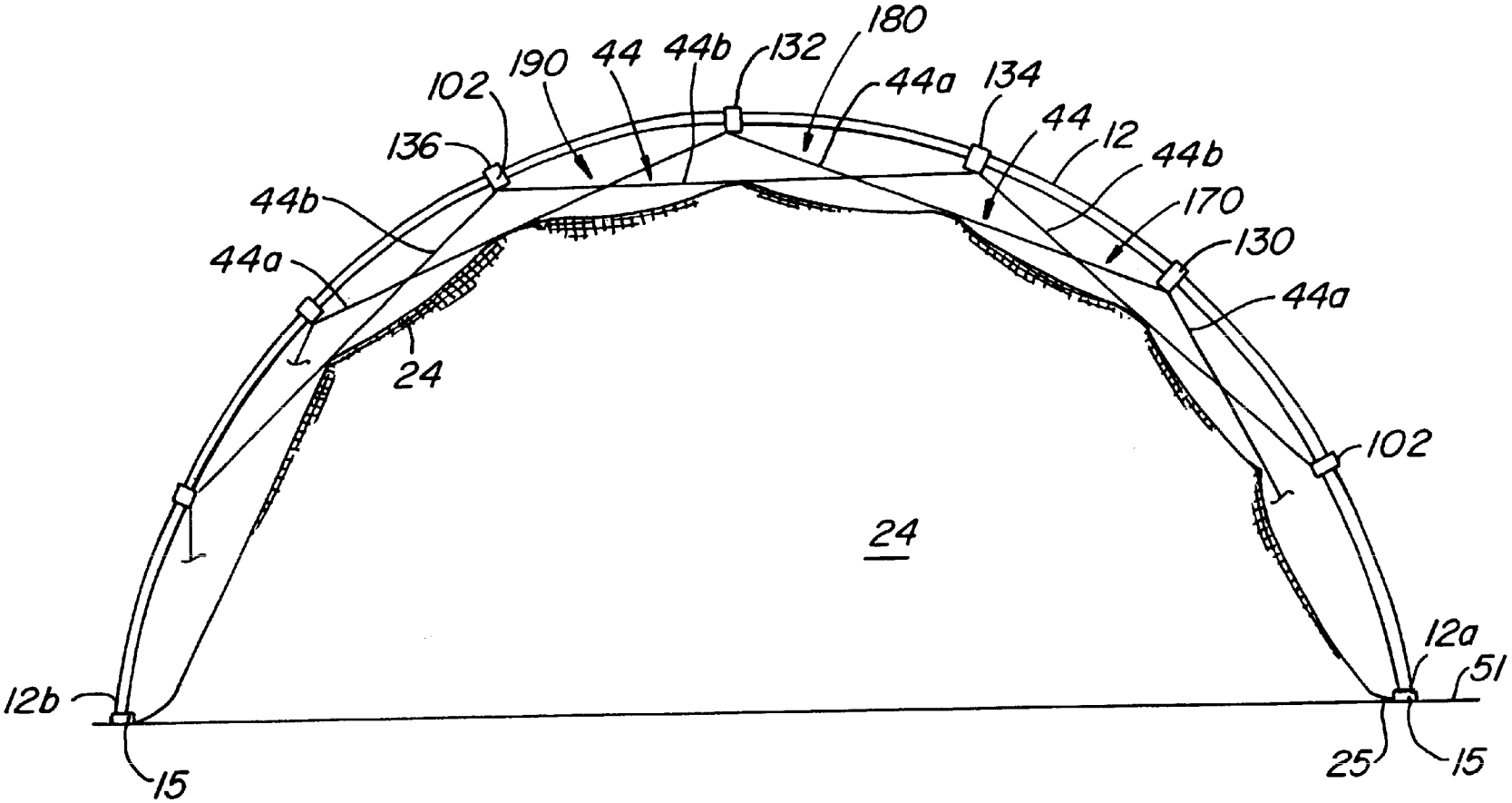
FIG. 9A is a front elevational view of a flexible structure comprising yet another presently preferred embodiment, wherein at least one deformable resilient pole element is maintained in a generally arcuate shape under tension by a tension web assembly comprising a plurality of tension members (i.e., cords, wires, or the like) each coupled to the pole at a plurality of locations, and further coupled to an underlying flexible member to define a sheltered space.
Figure 9B:
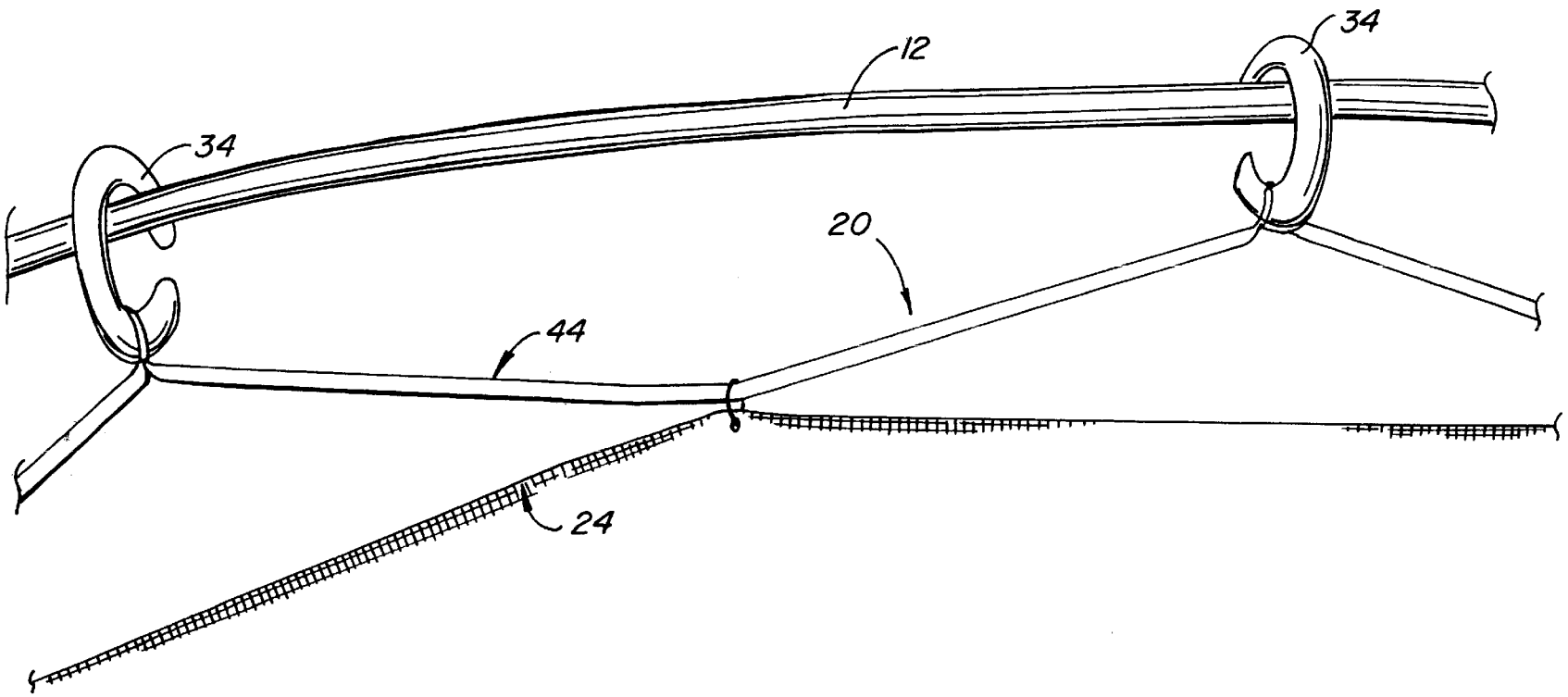
FIG. 9B is a partial side elevational view of a flexible structure comprising yet another presently preferred embodiment, wherein at least one deformable resilient pole element is maintained in a generally arcuate shape under tension by a tension web assembly comprising a low stretch element coupled to the pole by hooks and a low stretch member integrally formed with an underlying flexible member defining a sheltered space.
Figure 12:
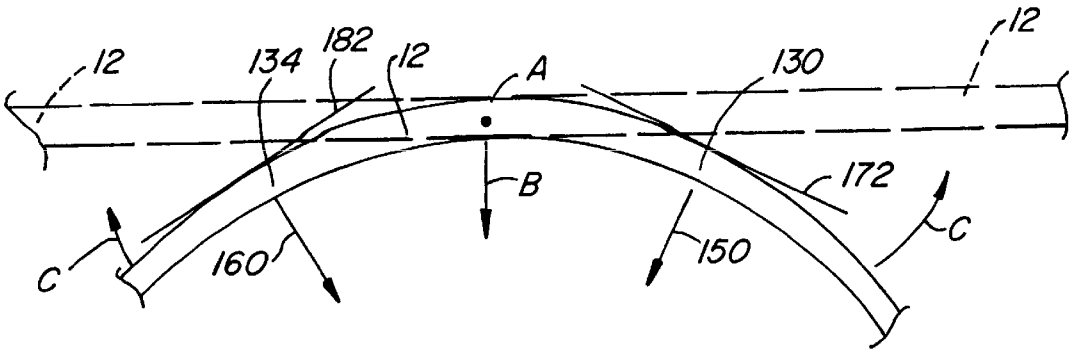
FIG. 12 is a schematic view illustrating a deformable resilient pole of the type used in the present invention maintained in a generally arcuate shape under tension, and showing the tension forces thereon in relation to potential coupling points of a tension web assembly of the invention.

Referring now to FIGS. 9A and 12, an example of operation of the invention and a method for maintaining at least one pole 12 in a desired shape under tension is described. As shown in FIG. 12, the deformable, resilient pole element 12 is substantially straight and untensioned initially. Tension members 44*a* and 44*b* are coupled to locations 130, 132, 134, 136 on the pole 12 via connectors 102. The tension members 44*a* and 44*b* form a plurality of geometric chords relative to the pole between connection points and impress an inward tension force on the pole 12, thus bending it into a desired shape, in this example generally arcuate, where it is maintained under tension.

The spacing of the coupling locations defines a plurality of zones. Zone 170 is located between locations 130 and 134. Similarly, zones 180 and 190 are respectively located underneath the arcuate-shaped stressed pole 12 between locations 132 and 134 and locations 132 and 136. In the particular example shown, the tension members 44*a* and 44*b* crisscross each other in zones 170, 180 and 190.

When external forces, for example due to wind, rain, or the weight of an exterior cover e.g., a "fly," are imposed on the structure 10, the tension forces on the pole 12 at coupling locations 130, 132, 134, and 136 resist deformation of the pole 12. Vectors 150 and 160 represent tension forces at the respective locations 130 and 134. Vector 150 represents a tension force that is in a direction which is generally normal or perpendicular with respect to a plane 172 which is tangent to the pole at the location 130. Similarly, vector 160 represents a tension force in a direction which is also generally normal or perpendicular with respect to a plane 182 that is tangent to the pole at the location 134. These tension forces act to resist deformation of the pole 12, for example at point A in the direction of the arrow B in FIG. 12, in response to application of external forces in that direction. While the foregoing description has used cords or the like as tension members 44*a* and 44*b*, those skilled in the art will appreciate the same operation and effects may be provided by properly selected plastic materials, or by properly selected woven materials, provided the tensile fibers are properly oriented as described previously. For example, the tensile fibers 101 of the web band 100 of the web assembly 20 would function the same as the cords by resisting the deformation of the pole(s) 12 under an external load.

In some applications, it may be desirable or necessary to impart additional stiffness or strength to the flexible structure 10 without altering the shape or profile of the structure. In those instances, it may be desirable to add strut members to the tension web assembly. FIGS. 19–21 illustrate additional preferred embodiments in which the tension web assembly 20 further includes strut members 220.

Figure 19A:
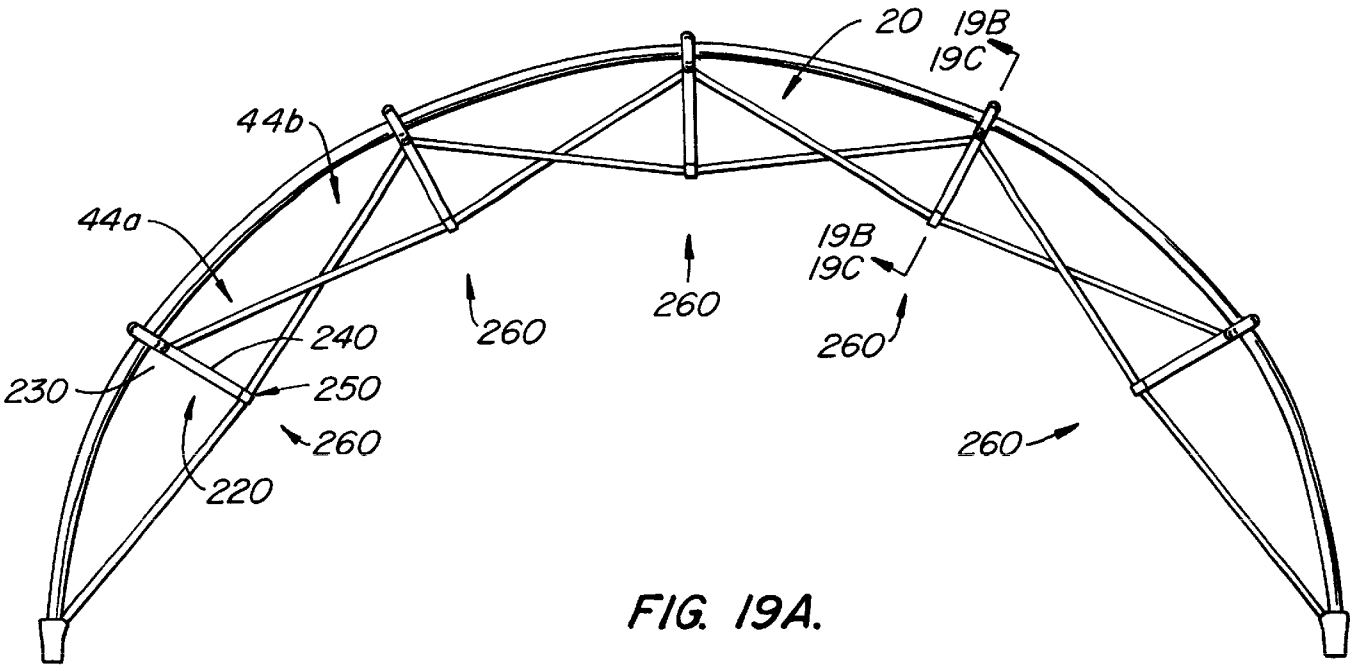
FIG. 19A is a front elevational view illustrating another presently preferred embodiment, wherein the web assembly includes a plurality of strut members.

Referring to FIG. 19A, the tension web assembly 20 incorporates at least one strut member 220, and preferably a plurality of such strut members. The strut members 220 may be incorporated at spaced locations 260 along the tension web to optimize the strength and rigidity of the structure.

Each strut member 220 preferably includes a first external end 230, an intermediary segment 240, and a second internal end 250. The external end 230 may be connected with the pole(s) 12 in a variety of manners, as will be described. The internal end 250 may be connected with the tension web assembly 20 also in a variety of suitable ways.

The strut members 220 are preferably formed of a rigid material in order to impart additional strength and rigidity to the structure and to resist deformation when external forces are applied to the structure. While in preferred embodiments, the strut members 220 are constructed of material such as molded or extruded plastic, lexan, carbon reinforced nylon, aluminum, titanium, steel or wood, those skilled in the art will realize that other suitable materials having similar properties could be used.

As shown in the preferred embodiment of FIG. 19A, the strut members 220 are preferably oriented substantially perpendicular to the tangent of the pole 12, and are in substantially co-planar arrangement with the pole. When properly aligned, the strut members 220 will act to provide tensile stiffness to counteract bending movement of the pole(s) 12 when a load or force is placed on the poles or flexible member 24.

The strut members 220, in cooperation with the tension web assembly 20, also serve to dampen or absorb any load or force which is applied to the pole(s) 12. Thus, similarly to what is shown in FIG. 7, in the embodiment of FIG. 19A, when a load or force is applied to the pole(s) 12, the strut member 220 is displaced from its non-loaded position. As the strut member 220 is forced to move in response to the load, however, its movement is increasingly constrained by counteracting forces generated by the tension members 44*a* and 44*b*, via the tension vectors 40*a* and 40*b*.

It is evident that the length of the strut member 220 is important to its function. The strut member preferably should be long enough so that the angle between the internal end 250 of the strut member 220 and the tension member 44*a* or 44*b* is less than 90 degrees when a load is applied to the structure in order to provide suitable force dampening.

Figure 19C:
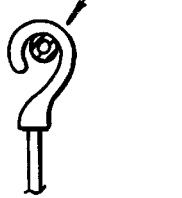
FIG. 19C is a vertical sectional view taken in the direction of the arrows and along the plane of line 19C—19C in FIG. 19A.
Figure 19B:
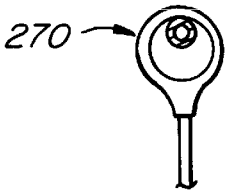
FIG. 19B is a vertical sectional view taken in the direction of the arrows and along the plane of line 19B—19B in FIG. 19A.

Other preferred embodiments of the invention are shown in FIGS. 19B and 19C. In these embodiments, the external end 230 of the strut member 220 is slidably connected with the pole element 12 by either a ring element 270 or a hook element 280. It will be appreciated by those skilled in the art that the strut member 220 may be fixedly secured to the pole 12, for example, by sizing the hook 280 to establish a friction fit with the pole 12. The strut member may also be configured to be either permanently or temporarily secured to the pole.

Figure 20A:
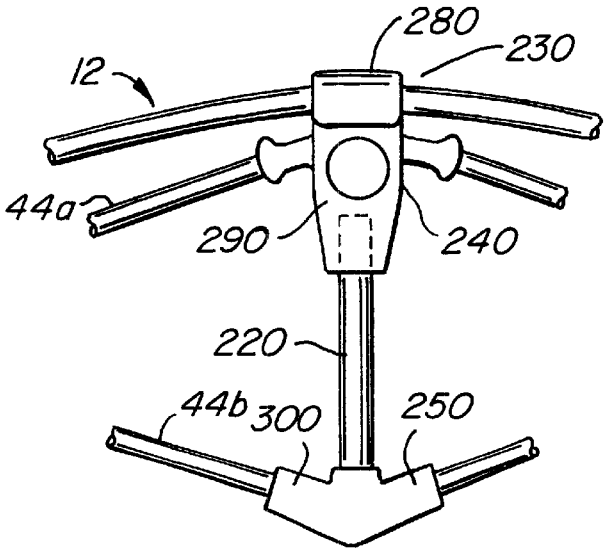
FIG. 20A is an enlarged elevational view of a preferred form of strut member with a preferred form of tension web as shown in FIG. 19A.

As best shown in FIGS. 20A–20F, strut members 220 may be incorporated into the tension web assembly 20 in a variety of ways. FIG. 20A depicts one preferred embodiment of a strut member 220 in cooperative connection with a pole 12 and the tension web assembly 20. The external end 230 and intermediary segment 240 of the strut member are joined via an external hub 290. The external end 230 of the strut member is configured with a hook 280, which is connected with the pole. The external hub is connected with tension member 44*a* in any suitable manner. One example would be inserting an end of the tension member through a hole in the hub and knotting the end of the tension member. Another would be passing the tension member through holes in opposing sides of the hub body. The internal end 250 of the strut is connected with an internal hub 300. The internal hub is similarly connected with tension member 44*b* in any suitable manner.

Figure 20B:
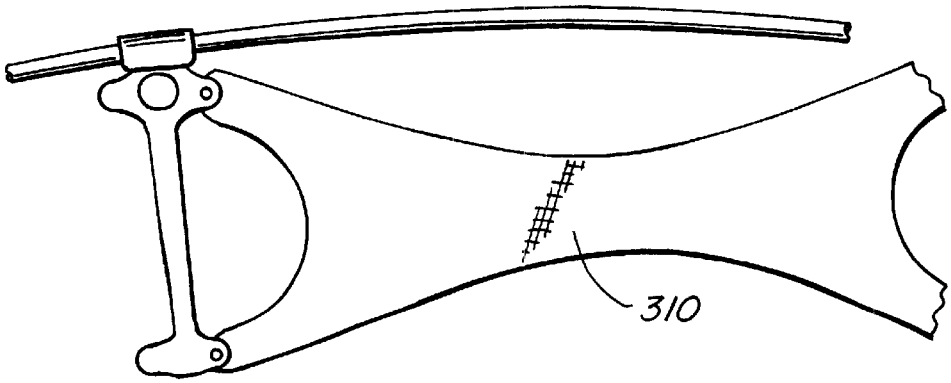
FIG. 20B is an enlarged elevational view of a preferred form of strut member as shown in FIG. 19A, with another preferred form of tension web shown.

FIG. 20B illustrates another preferred embodiment of a strut member 220 in cooperative connection with a pole 12 and the tension web assembly 20. In this embodiment, the tension members 44*a* and 44*b* are exemplified as a single tension band 310. The tension band 310 is connected with both the external and the internal end 250 of the strut member 220 in any suitable manner. As shown, the strut member may be one contiguous structure.

Figure 20C:
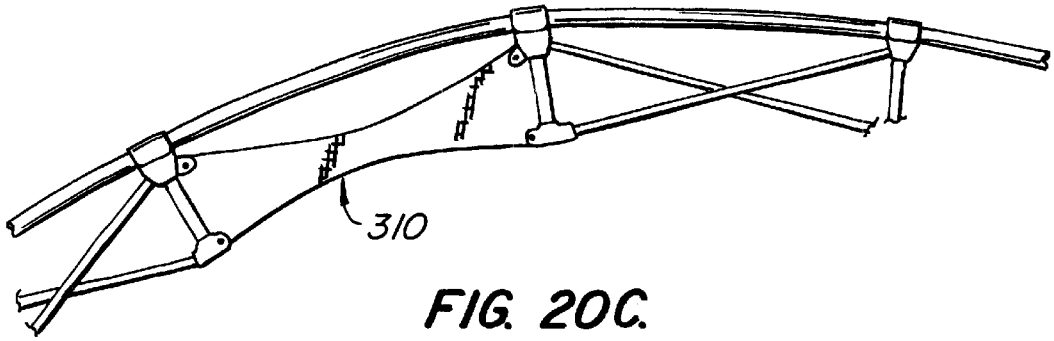
FIG. 20C is an enlarged elevational view illustrating another presently preferred embodiment of a tension web with strut members and employing alternating types of tension members.

It will be appreciated by persons skilled in the art that the strut member 220 can be separate, or contiguous with, the tension web assembly 20. FIG. 20C illustrates a preferred embodiment of a tension web assembly which incorporates strut members and in which alternate forms of tension members (both contiguous and separate) are employed. In this embodiment, the tension band 310 is integrally connected to the strut member along a length of the strut member, whereas the separate tension members are connected in any suitable manner as pointed out previously.

Figure 20D:
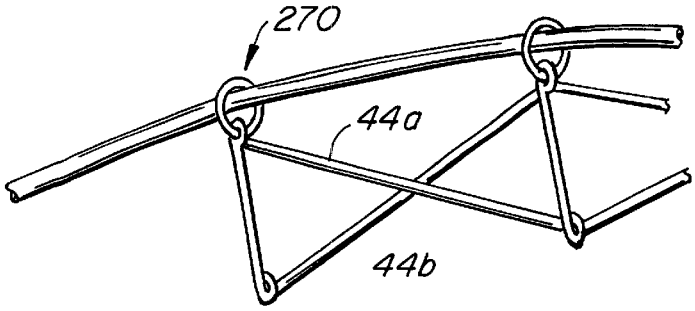
FIG. 20D is an enlarged elevational view depicting a preferred form of strut member.
Figure 20E:
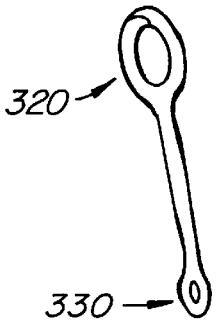
FIG. 20E is an enlarged elevational view of another preferred form of strut member.
Figure 20F:
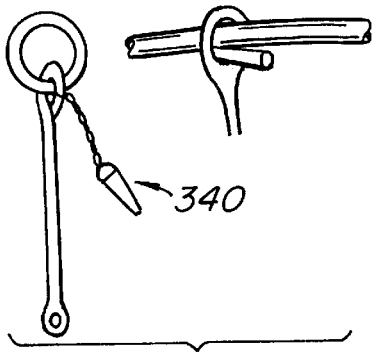
FIG. 20F is an enlarged elevational view of yet another preferred form of strut member.

FIG. 20D depicts yet another presently preferred embodiment of a tension web assembly which incorporates strut members 220. In this embodiment, the external end 230 of the strut member is configured with a ring 270, thus allowing the strut member to be slidably connected with the pole. As further shown in FIG. 20E, the intermediary segment of the strut member is configured with an eyelet 320, and the internal end of the strut member is configured with an eyelet 330. The eyelet 320 is connected with the ring 270 and the tension member 44*a*, while the eyelet 330 is connected with the tension member 44*b*. FIG. 20F illustrates another embodiment of the strut member of FIG. 20D, wherein the ring 270 may be securely compressed against the pole 12 by inserting a wedge 340 into the ring 270. In this way, the strut member 220 is fixedly connected with the pole via a friction fit.

Figure 21A:
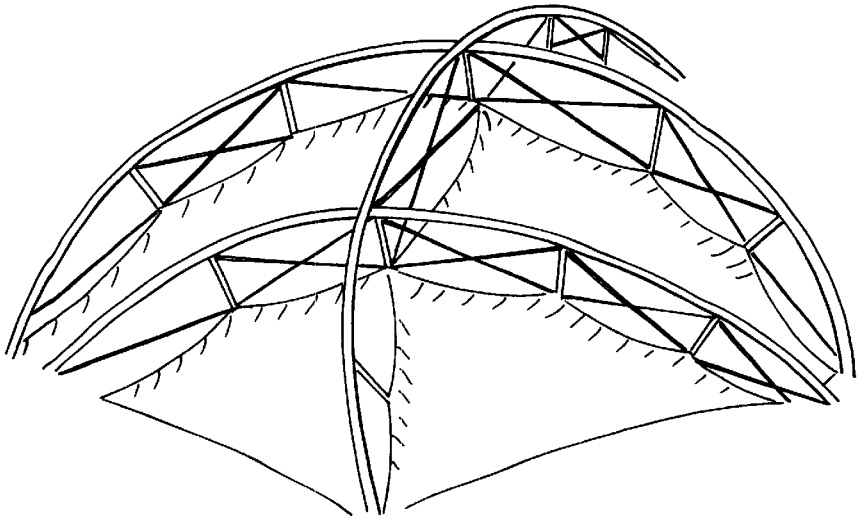
FIG. 21A is a perspective view showing another presently preferred embodiment of a flexible structure similar to that depicted in FIG. 1 wherein the tension web assembly incorporates a plurality of strut members.

FIG. 21A illustrates a flexible structure 10 having a plurality of poles 12 similarly to the structure shown in FIG. 1 described previously. Associated with each pole is a tension web assembly 20 incorporating a plurality of strut members 220 at spaced locations. While the embodiment shown has a plurality of poles, it is appreciated that the present invention may incorporate one or more poles. Further, while the embodiment shown generally has one tension web member per pole, it will be appreciated that the structure may omit web members from some poles and may omit strut members from some tension members depending on the shape, strength, purpose and other parameters of the desired structure.

While the present invention has been described herein with reference to particular presently preferred embodiments thereof, a variety of modifications, changes, and substitutions are envisioned in the foregoing disclosure, and will be appreciated by those skilled in the art. For example, in some instances certain features of the invention may be employed without a corresponding use of other features without departing from the intended scope and spirit of the invention. Additionally, modifications may be made to adapt a particular situation or material to the teachings of the invention without departing from the essential scope and spirit thereof. Accordingly, it is intended that the invention not be limited to the particular embodiments disclosed, but that it will include all embodiments and equivalents falling within the scope of the appended claims.

What is claimed is:

1. A flexible structure comprising:

at least one deformable, resilient pole; and at least one tension web coupled to said pole and maintaining said pole in a selected shape under tension, said tension web including at least one strut member.

2. The flexible structure of claim 1 wherein said tension web is coupled to said pole by said at least one strut member.

3. The flexible structure of claim 1 including a plurality of strut members positioned along said tension web at a plurality of spaced locations.

4. The flexible structure of claim 1 wherein said at least one strut member is aligned substantially perpendicular to the tangent of the pole.

5. The flexible structure of claim 1 wherein said at least one strut member is comprised of a rigid material.

6. The flexible structure of claim 1 wherein said at least one strut member is in substantially co-planar orientation with the pole.

7. The flexible structure of claim 1 wherein said tension web is fixedly coupled with said pole.

8. The flexible structure of claim 1, including a flexible member coupled to said structure and defining a sheltered space.

9. The flexible structure of claim 1 wherein said tension web comprises a plurality of tension members.

10. A flexible dome structure comprising:

a plurality of deformable, resilient poles arranged in crossing relationship;

a tension web assembly coupled to at least some of said poles and maintaining said poles in a generally arcuate shape under tension, said tension web assembly including at least one strut member.

11. The flexible dome structure of claim 10 including a flexible membrane coupled to said structure defining a sheltered space.

12. The flexible dome structure of claim 10 wherein said tension web assembly comprises a plurality of tension members and wherein a plurality of poles have at least one tension member coupled thereto.

13. The flexible dome structure of claim 12 wherein said tension web assembly includes a plurality of strut members and wherein each said tension member coupled to a pole is coupled to said pole by at least one strut member.

14. The flexible dome structure of claim 12 wherein said tension web assembly includes a plurality of strut members positioned at spaced locations along at least one of said tension members.

15. The flexible dome structure of claim 10 wherein said at least one strut member is a rigid member.

16. The flexible dome structure of claim 10 wherein said at least one strut member is oriented substantially perpendicular to the tangent of at least one of said poles.

17. The flexible dome structure of claim 10 wherein said at least one strut member is oriented substantially co-planar with respect to at least one of said poles.

18. A flexible structure comprising:

a plurality of deformable, resilient poles;

a tension web assembly coupled to at least some of said poles and maintaining said poles in a selected shape under tension, said tension web assembly including at least one strut member.

19. The flexible structure of claim 18 wherein said tension web assembly is configured to oppose bending of the poles in response to an external force applied to the structure.

20. The flexible dome structure of claim 18 wherein said tension web assembly is configured to dampen external force applied to said structure.

* * * * *